US011337577B2

(12) United States Patent
Tyroler

(10) Patent No.: US 11,337,577 B2
(45) Date of Patent: May 24, 2022

(54) MOPPING UNIT

(71) Applicant: Tyroler Ltd., Neve Yamin (IL)

(72) Inventor: Dan Tyroler, Yesod HaMa'ala (IL)

(73) Assignee: Tyroler Ltd., Neve Yamin (IL)

( * ) Notice: Subject to any disclaimer, the term of this patent is extended or adjusted under 35 U.S.C. 154(b) by 249 days.

(21) Appl. No.: 16/584,255

(22) Filed: Sep. 26, 2019

(65) Prior Publication Data

US 2021/0093148 A1 Apr. 1, 2021

(51) Int. Cl.
*A47L 13/256* (2006.01)
*A47L 13/258* (2006.01)

(52) U.S. Cl.
CPC ..... *A47L 13/256* (2013.01); *A47L 13/258* (2013.01)

(58) Field of Classification Search
CPC ..... A47L 13/24; A47L 13/254; A47L 13/256; A47L 13/20; A47L 13/44
See application file for complete search history.

(56) References Cited

U.S. PATENT DOCUMENTS 3,775,802 A * 12/1973 Grassman ..... A47L 13/254 15/147.2
2011/0203065 A1* 8/2011 Cassar ..... B25G 3/38 15/144.2
2014/0259499 A1* 9/2014 Post ..... A47L 1/15 15/231
2017/0135546 A1* 5/2017 Apcar ..... B24D 15/023
2017/0215686 A1* 8/2017 Smith ..... A47L 13/256

* cited by examiner

*Primary Examiner* — Shay Karls
(74) *Attorney, Agent, or Firm* — Vorys, Sater, Seymour & Pease LLP; William L. Klima

(57) ABSTRACT

Provided is a mopping unit including: a mop base, a head unit and a coupling element; wherein the coupling element having two parallel elongated reinforcing end segments integral with and flanking a central, coupling segment; the base, being a single-piece molded article having a bottom face and a top face; two elongated bores are formed in elongated abutments on the top face, each accommodating one of the two reinforcing end segments; the base being configured for attaching a mopping substrate on the bottom face; and wherein the head unit being pivotally coupled to said central segment to permit it to pivot about a first axis essentially parallel to said central segment and including a receptacle for an end of a mopping handle.

18 Claims, 5 Drawing Sheets

MOPPING UNIT

TECHNOLOGICAL FIELD

The present disclosure is in the field of improvements of cleaning units, in particular a mopping unit.

BACKGROUND

There are many kinds of mopping units that have a flat mop base, all are made of rigid materials that are attached or connected to a cleaning cloth.

The rigid base has a joint knuckle arrangement that connect between the base and the mop handle.

There are a few mop base structures and methods to attach the rigid mop base to the cleaning cloth, for example:

(i) forming the base from two parts that can be separated and then inserted into pockets of the cleaning cloth. These kind of units are made of multiple parts connected to each other. Consequently, some of these multiple parts tend to break easily, which then makes it very complicated to insert the mop base into the cloth pockets.

(ii) forming a rigid one piece (usually made of aluminum) that glued to Velcro strips on its bottom. This glued Velcro typically pills off after a short time and after that the cleaning cloth can no longer be attached to the base. Rigid and flat mop base is usually made of aluminum, which is expensive. Manufacturing of rigid and flat mop base from plastic is complicated and thus can be relatively expensive.

Furthermore, rigid mop bases that are known in the field are easily scratch and damage furniture that come into contact therewith.

GENERAL DESCRIPTION

The present disclosure discloses a mopping unit and a method for manufacturing thereof. The mopping unit is formed of two parts, a mop base and a head unit that are integrally bonded to one another through a coupling-reinforcing element to form together a single-integral casted unit. The mop base is a single-piece molded article that is made of a relatively flexible material, e.g. silicon rubber, rubber, a thermoplastic material or the like. The mop base is generally flat and has a planar bottom face and a generally planar top face with coupling element receiving formation formed thereon. The coupling element receiving formations are in the form of abutments protruding from the top face of the mop base. Elongated bores are formed in the abutments such they are formed around end segments of the coupling element to hold them tight in position. This is achieved by molding the coupling element receiving formations in the form of elongated bores within abutments around the end segments. The coupling element is rigid and grants the abutments and their surrounding portions at the mop base reinforcing properties. Therefore, while peripheral portions of the mop base are flexible due to the flexible material forming it and its relatively small thickness, the middle portion thereof, which is defined by the elongated abutments and their surrounding, is stiff.

The mop base is configured for attachment of a mopping substrate to the bottom face thereof, e.g. by touch fasteners such as Velcro-type fasteners. In some embodiments, the touch fasteners are sewn to the bottom face of the mop base.

The head unit is coupled to a central segment of the coupling element through a coupling hinge element, i.e. a pivotal coupling, that envelopes the central segment and allows rotational movement of the head unit around an axis defined by the central segment of the coupling element. In some embodiments, the end segments and the central segments are co-axial and the head unit is rotating around an axis parallel to all segments of the coupling element.

The head unit includes a mopping handle (e.g. a stick) receptacle for receiving a mopping handle. It is to be noted that the handle may be integral with the head unit or be received in an attachable/detachable manner.

An aspect of the present disclosure provides a mopping unit that includes a mop base, a head unit and a coupling element. The coupling element has two parallel elongated reinforcing end segments that are integral with and flanking a central, coupling segment. The mop base is a single-piece molded article that includes a bottom face, a top face and two elongated bores that are formed in elongated abutments on the top face. The abutments are typically slightly elevated above the top face, and the bores has a portion that is on the same plane of the top face of the base. This gives the mopping unit stability and avoiding turn-overs of the base since the coupling element is positioned at a relatively low position above the top face of the base or positioned at the same plane as the mop base. Each of the elongated bores accommodates one of the two reinforcing end segments. In other words, the reinforcing end segments laterally extend from the central segment to two opposite directions and are received by the elongated bores. The base is configured for attaching a mopping substrate on the bottom face in an attachable/detachable manner, the attachment elements that are configured to attach the mopping substrate can be either on the top or bottom faces. The head unit is being pivotally coupled by a pivotal coupling, e.g. hinged, to the central segment to permit it to pivot around a first axis that is essentially parallel to the central segment. The head unit further includes a receptacle for receiving an end of a mopping handle.

In some embodiments of the mopping unit, the two elongated bores are co-axial and the coupling element is an elongated handle. The elongated rod is made of a rigid material such as metal. It is to be noted that the different segments of the elongated rod are defined by their position, i.e. ends and center of the rod. Each segment of the rod is typically similar to each of the other segments, e.g. similar texture and formation.

In some embodiments of the mopping unit, each of the two elongated bores has an open end, the two open ends face one another and span a central gap, into which the central segment fits. The majority of the central segment is enveloped by the pivotal coupling, leaving a small portion that is exposed from each side of the pivotal coupling.

In some embodiments of the mopping unit, the base is sufficiently flexible or pliable to permit the mop base, or at least portions of the mop base, to bend about corners. While some portions of the mop base are capable of bending about corners, other portions of the mop base, e.g. the abutments, maintain stiff and do not bend.

In some embodiments of the mopping unit, the base is made of silicone rubber, any type of rubber or a thermoplastic material.

In some embodiments of the mopping unit, the base is elongated in a direction parallel to the reinforcing end segments. For example, the base can be of a rectangular shape.

In some embodiments of the mopping unit, the head unit has a coupling portion enveloping the central segment.

Namely, the pivotal coupling is entirely surrounding and enveloping the central segment.

In some embodiments of the mopping unit, the head unit has one part pivotally attached to the central segment and a second part that includes the handle receptacle. The two parts are being hinged to one another and rotational one versus the other about a second axis normal to the first axis, therefore allowing the rotation of the head unit around two perpendicular axes.

In some embodiments of the mopping unit, the base includes one or more ribs on the top face of the mop base, extending from the abutments in a direction normal to the first axis towards the top face. The ribs provide additional rigidity to the central portion of the mop base that includes the elongated abutments and their surrounding that is to defined by the ribs.

In some embodiments of the mopping unit, the ribs extend symmetrically from the two sides of the abutments to two opposite directions.

In some embodiments of the mopping unit, the bottom face has fastening elements for attaching the mopping substrate thereto. In some embodiments, the fastening elements are one of a hook-and-pile, i.e. Velcro-type, coupling.

In some embodiments of the mopping unit, the fastening elements are seamed to the bottom base. The seaming of the fastening elements to the bottom face is permitted due to the relatively soft material that forms the mop base that allows seams to pass therethrough easily.

In some embodiments of the mopping unit, each of the reinforcing end segments is at least two times larger, or three time larger than the central segment of the coupling element.

In some embodiments of the mopping unit, the abutments are formed at equal distance from opposite edges of the base, namely the abutments are formed at a middle portion of the base. In the embodiment wherein the base is rectangular, the abutments are formed parallel to the long edges of the rectangle and equally-distanced therefrom.

In some embodiments of the mopping unit, the peripheral portion of the base is flexible, i.e. the edges of the mop base and the portions in the vicinity thereof.

In some embodiments of the mopping unit, the peripheral portion includes fastening elements for said mopping substrate.

The peripheral portion is defined between the edges of the mop and the minimal distance from portions of the abutments or the ribs.

In some embodiments of the mopping unit, the mop base is generally planar and flat, i.e. is planar, has a relatively low thickness and has abutments formed thereon. Optionally, the mop base has reinforcing ribs formed on its top face.

Yet another aspect of the present disclosure provides a method for manufacturing a mopping unit. The method includes molding a generally planar mop base that has a bottom and top face, and abutments on its top face such that the abutments are formed over two parallel reinforcing end segments of a coupling element. The reinforcing end segments are integral with and flanking a central, coupling segment and the coupling element is pivotally coupled to a head unit that has a handle receptacle.

The method further includes fixing fastening elements for attachment of a mopping substrate, e.g. a cleaning cloth, to the bottom face of the mop base.

In some embodiments of the method, the base is formed of silicon rubber, rubber of any type or a thermoplastic material.

In some embodiments of the method, the fixing of attachment elements includes sewing the attaching elements to the bottom face of the mop base.

In some embodiments, the method includes, prior to molding, assembling the coupling element with the head unit such that a coupling portion, e.g. a pivotally coupling of the head unit envelopes the central segment of the coupling element.

Yet another aspect of the present disclosure provides a mop base, being a single-piece molded article, that includes a coupling element, a bottom face and a top face. The mop base is configured to be a part of a mopping unit and to be coupled to head unit through a coupling element, the head unit is coupled to a mopping handle for utilizing the mop base when is coupled to the head unit.

The coupling element has two parallel elongated reinforcing end segments integral with and flanking a central, coupling segment. Two elongated bores are formed in elongated abutments on the top face, each is accommodating one of the two reinforcing end segments. Therefore, the reinforcing end segments laterally extend from the central segment to two opposite directions and are received by the elongated bores. The abutments are typically slightly elevated above the top face, and the bores has a portion that typically lies on the same plane of the top face of the base.

The base is configured for attaching a mopping substrate on its bottom face in an attachable/detachable manner.

In some embodiments, the mop base is generally planar, wherein the bottom face of the mop base is planar and the top face is planar with the abutments formed thereon. Optionally, reinforcing ribs are formed on the top face extending from the abutments towards the top face of the mop base. In some embodiments, the ribs extend symmetrically from the two sides of the abutments.

In some embodiments of the mop base, the two elongated bores are co-axial.

In some embodiments of the mop base, the two open ends face one another and span a central gap, into which a central segment of a coupling element configured for coupling a head unit fits.

In some embodiments, the mop base is sufficiently flexible or pliable to permit the base to bend about corners.

In some embodiments, the mop base is made of silicon rubber, rubber of any type or a thermoplastic material.

In some embodiments, the mop base is elongated in a direction parallel to the reinforcing end segments. In some embodiments, the mop base is rectangular.

In some embodiments of the mop base, the bottom face has fastening elements for attaching and fastening the mopping substrate.

In some embodiments of the mop base, the fastening elements are one of a hook-and-pile, i.e. Velcro-type coupling.

In some embodiments of the mop base, the fastening elements are seamed to the bottom base.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 1A is a perspective top view; FIG. 1B is a side view; FIG. 1C is a top view; and FIG. 1D is a bottom view.

DETAILED DESCRIPTION OF EMBODIMENTS

The following figures are provided to exemplify embodiments and realization of the invention of the present disclosure.

Figure 4:
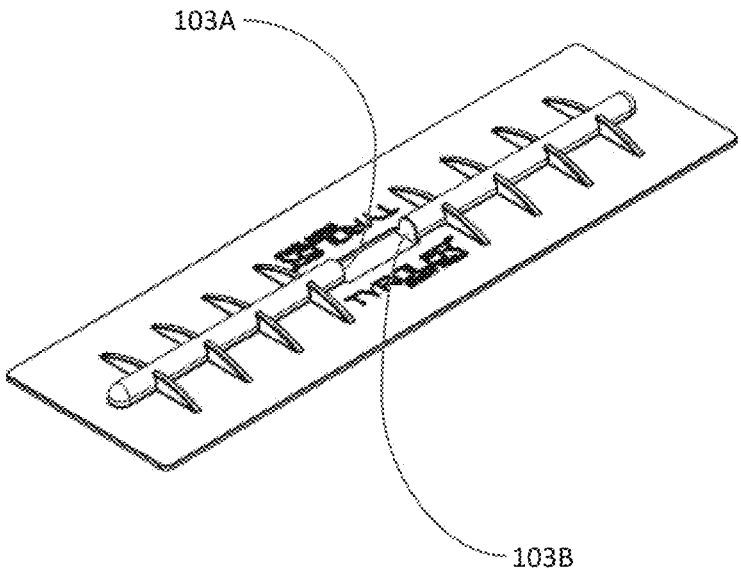
FIG. 4 is a schematic illustration of a perspective view of a non-limiting example of the mop base of the present disclosure.

FIGS. 1A-1D are schematic illustrations of a different views of a non-limiting example of the mopping unit of the present disclosure. The mopping unit 100 includes a mop base 102 that is a single-piece molding article, namely it is a result of a use of a single mold. The mop base 102 is generally planar and has two elongated bores 103A and 103B, formed by two elongated abutments 104A, 104B and extending along an axis X, which is parallel to long edges 106A and 106B and normal to short edges 108A and 108B of the mop base 102. The elongated bores 203A and 203B are best seen in FIG. 4, which is a schematic illustration of a perspective view of a non-limiting example of the mop base alone. The two elongated abutments 104A and 104B protrude from a planar portion of the mop base 102 and are formed around portions of a coupling element 109, e.g. a rod that is made of metal, that is configured to couple a head unit 110 to the mop base 102. In this example, the coupling element is an elongated stiff road, e.g. made of metal, wherein a central segment thereof 112 is entirely enveloped by a pivot element 114 of the head unit 110 that is configured to allow the rotation of the head unit around the axis defined by the coupling element 108, i.e. axis X. The pivot element 114 completely surrounds the central segment 112 of the coupling element 108 such that it cannot be pulled out and decoupled from the coupling element 108. End segments 116A and 116B of the coupling element 108 are received in the elongated bores 103A and 103B, respectively, such they are entirely enveloped by the elongated abutments 104A and 104B. This structure is obtained by first assembling the pivot element 114 on the coupling element 108, following by molding the mop base 102 around the end segments 116A and 116B of the coupling element 108 such that they are surrounded and enveloped by the elongated bores elongated abutments 104A and 104B, respectively.

It is to be noted that since the coupling element is entirely covered by the abutments and the pivot element, it is not seen in the figures and the numerical references that refer thereto point to the elements that envelope it.

The head unit 110 has a handle receptacle 118 that is configured to receive a mopping handle 120 for allowing a subject to utilize the mopping unit 100. In this non-limiting example, the head unit is formed of two parts hinged to one another, a first part 122, including the pivot element 114, and a second part 124, including the handle receptacle 118. The first and second parts 122 and 124 are pivotable one with respect to the other to allow a rotation around an axis Y that is normal to the coupling element 108, and in this example parallel to short edges 108A and 108B of the mop base 102.

It is to be noted, that the mopping unit may include a single-part head unit that is rotatable only around the coupling element.

The mop base 102 is formed of a planar portion 126 on which the two elongated abutments 104A and 104B are formed. The thickness $d_1$ of the planar portion 126 is smaller than the largest dimension of the two elongated abutments 104A and 104B, e.g. their diameter $d_2$, as can be best seen in FIG. 1B.

The mop base 102 includes couples of symmetrical ribs 128 extending normal to the elongated abutments 104A and 104B. Each rib 128 is integral with a portion of one of the abutments and a top face 130 of the planar portion 126 of the mop base 102. The ribs 128 are formed to give an extra stiffness to the central portion of the mop base 102, namely the portion that includes the abutments and the vicinity thereof.

Figure 1A:
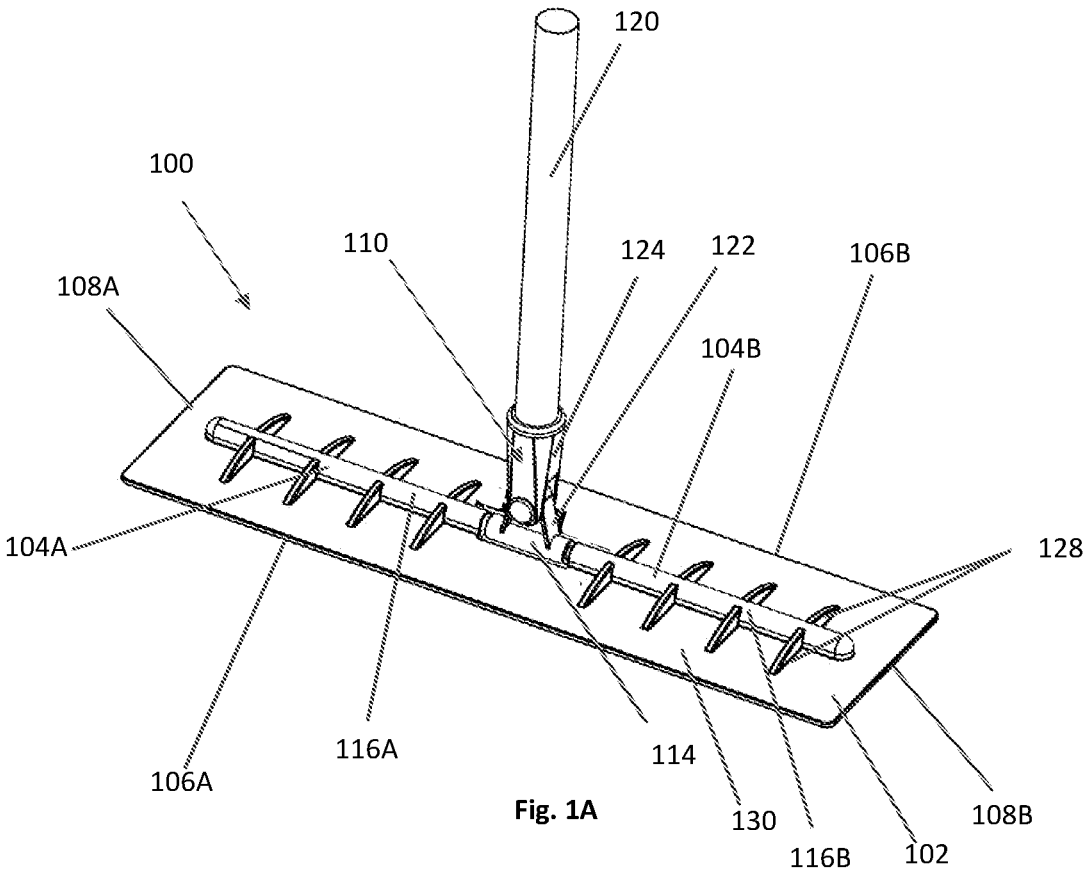
FIGS. 1A-1D are schematic illustrations of a different views of a non-limiting example of the mopping unit of the present disclosure.
Figure 1B:
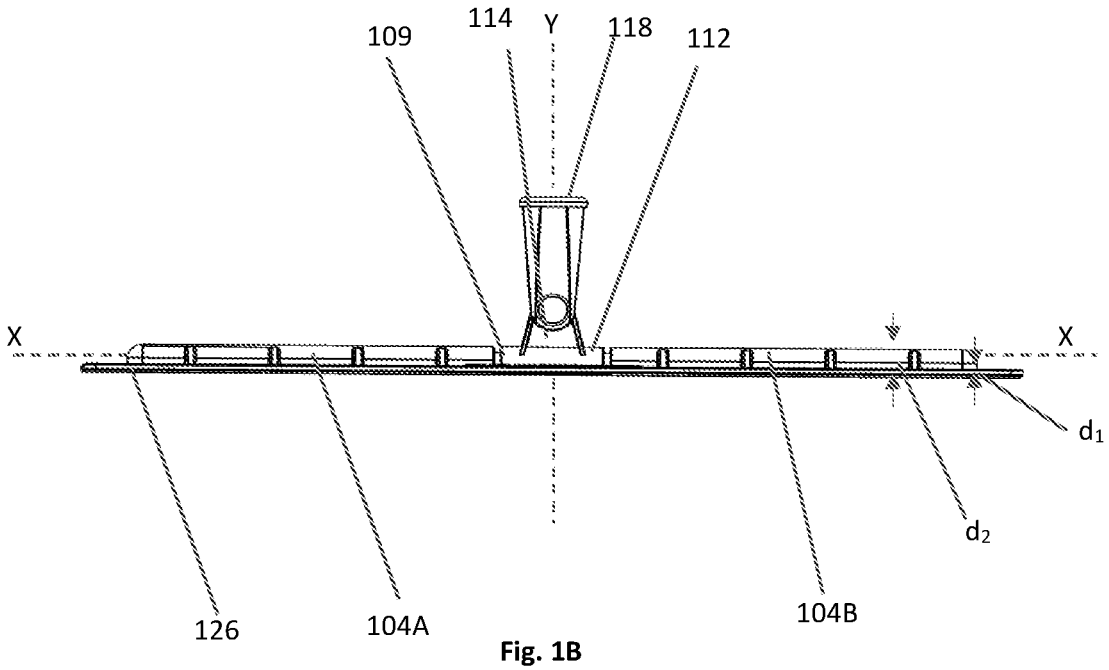
Figure 1C:
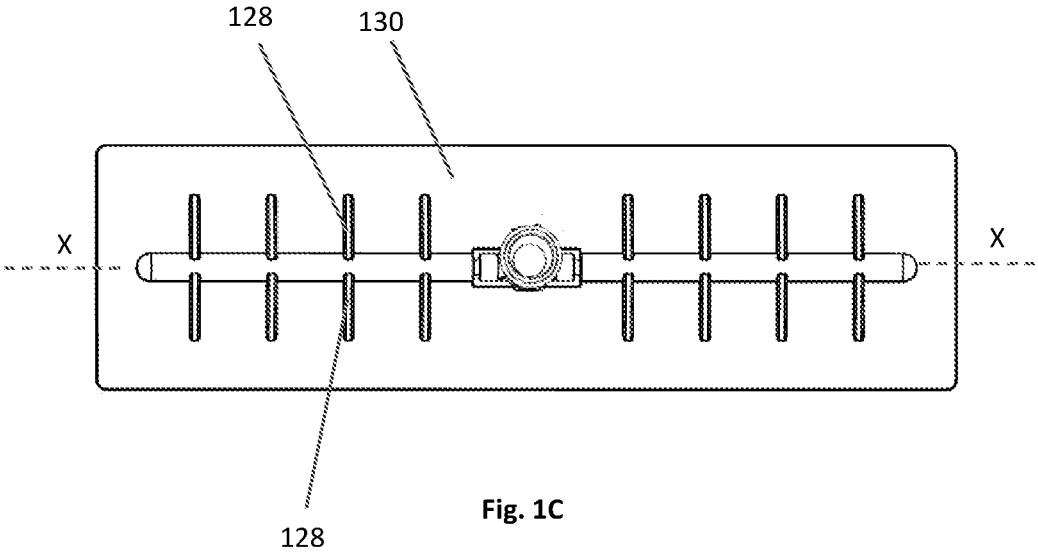
Figure 1D:
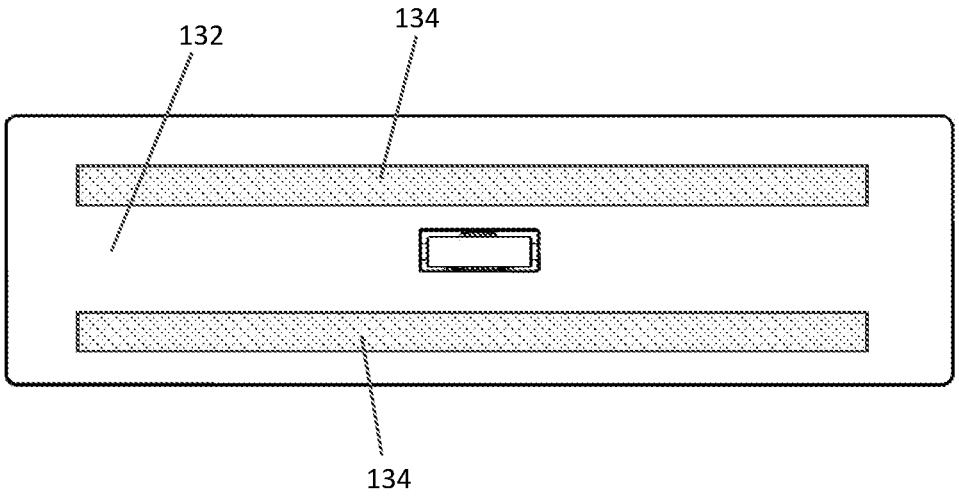
Figure 2:
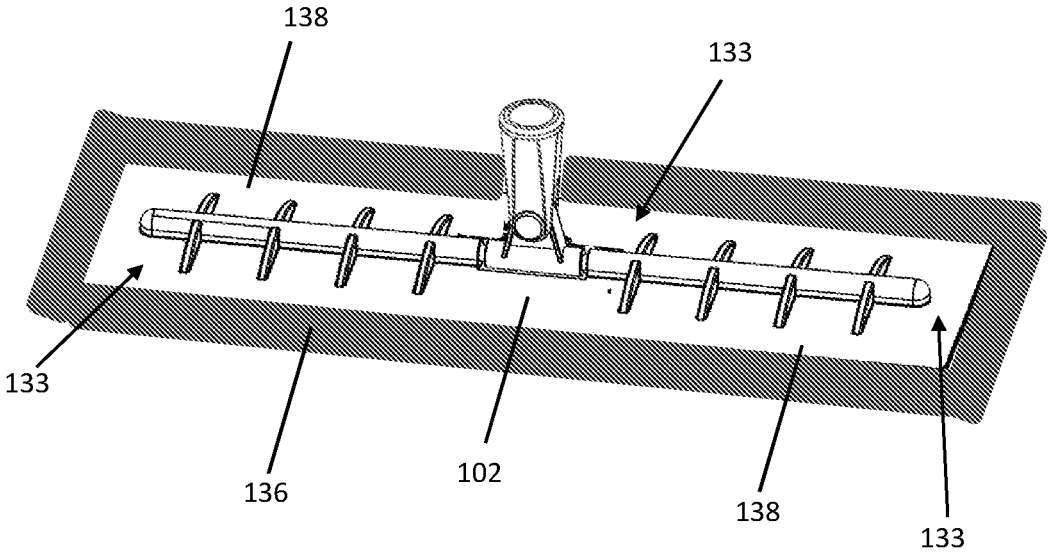
FIG. 2 is a non-limiting example of an image of the mopping unit of the present disclosure that is attached to a mopping substrate.

The bottom face 132 of the planar portion 126 includes fastening elements 134 that are configured to attach a mopping substrate 136. A mopping substrate 136 being attached to the bottom face of the planar portion of the mop base is demonstrated in FIG. 2, which is a non-limiting example of an image of the mopping unit of the present disclosure. In the example of FIG. 2, the fastening elements (not shown) are seamed to the bottom face by seams 138 passing through the top and the bottom face 130 and 132 of the planar portion 126 and extending along the vicinity of the long edges 106A and 106B at a peripheral portion 133 of the mop base 102. The fastening elements may be of a Velcro-type seamed to the bottom face 130 of the planar portion 126.

The mop base 102 is formed of a material sufficiently flexible to allow the thin peripheral portions 133 of the mop base 102 to flex and bend about corners while the central part remains relatively stiff. For example, the mob base can be formed of silicon rubber, rubber or the like.

Figure 3A:
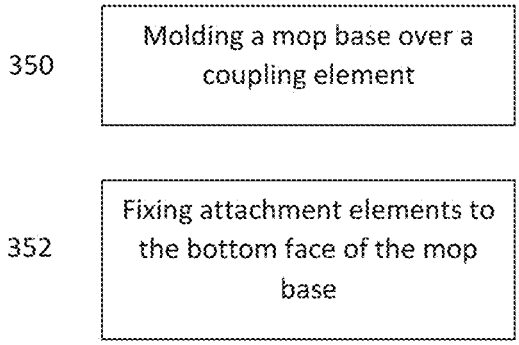
FIGS. 3A-3B are flow diagrams of non-limiting examples of methods for manufacturing the mopping unit of the present disclosure.
Figure 3B:
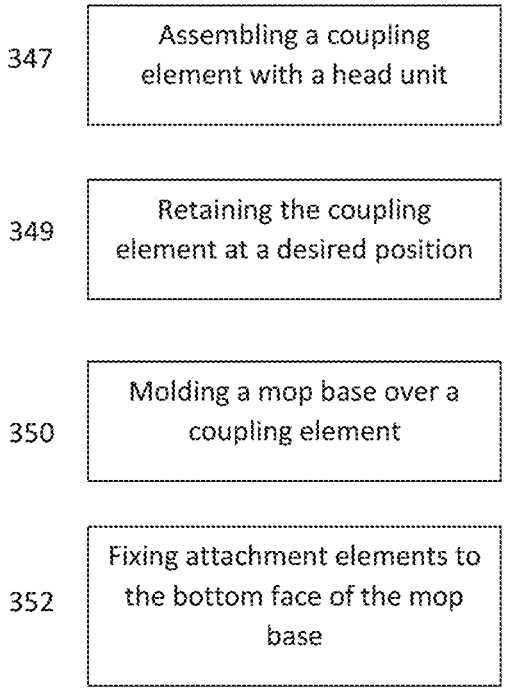

FIGS. 3A-3B are flow diagrams of non-limiting examples of methods to manufacture the mopping unit of the present disclosure.

FIG. 3A exemplifies a method that includes molding a mop base over coupling element 350. The mop base is having a bottom and top face and abutments on its top face such that the abutments are formed over two parallel reinforcing end segments of the coupling element. The reinforcing end segments are integral with and flanking a central, coupling segment and the coupling element is coupled to a head unit that has a handle receptacle. The method further includes fixing attachment/fastening elements to the bottom face of the mop base 352. The attachment elements are configured to attach a mopping substrate to the bottom face.

The method exemplified in FIG. 3B differs from that of FIG. 3B by that prior to the molding, the method includes assembling the coupling element with the head unit 347 such that a coupling portion of the head unit envelopes the central segment of the coupling element. Furthermore, the method includes retaining the coupling element at a desired position 349 such that during the molding 350, the coupling element maintain its position to be received in the bores and enveloped by the abutments. The retention is carried out by retaining elements that are holding the coupling element during the molding process and are being removed once the molding process is over.

The invention claimed is:

1. A mopping unit comprising:

a mop base;

a head unit; and a coupling element having two parallel elongated reinforcing end segments integral with and flanking a central, coupling segment, wherein the mop base is a single-piece molded article made of rubber or silicone rubber, and comprises:

a bottom face and a top face; and two elongated bores formed in elongated abutments on the top face, each accommodating one of the two reinforcing end segments;

wherein the mop base is configured for attaching a mopping substrate on the bottom face, wherein the head unit is pivotally coupled to said central segment to permit it to pivot about a first axis essentially parallel to said central segment, and comprising a receptacle for an end of a mopping handle, wherein the head unit includes a coupling portion entirely enveloping the central segment, and wherein the base comprises one or more ribs on the top face, extending from said abutments in a direction normal to the first axis.

2. The mopping unit of claim 1, wherein the two elongated bores are co-axial and the coupling element is an elongated rod.

3. The mopping unit of claim 2, wherein each of the two elongated bores has an open end, the two open ends face one another and span a central gap, into which the central segment fits.

4. The mopping unit of claim 1, wherein the base is sufficiently flexible or pliable to permit the base to bend about corners.

5. The mopping unit of claim 1, wherein the head unit has one part pivotally attached to said central segment and a second part with said receptacle, the two parts being hinged to one another and rotational one versus the other about a second axis normal to the first axis.

6. The mopping unit of claim 1, wherein the ribs extend symmetrically from the two sides of said abutments.

7. The mopping unit of claim 1, wherein the bottom face has fastening elements for said mopping substrate.

8. The mopping unit of claim 7, wherein the fastening elements are one of a hook-and-pile coupling.

9. The mopping unit of claim 7, wherein the fastening elements are seamed to said bottom base.

10. The mopping unit of claim 1, wherein said abutments are formed at equal distance from opposite edges of the base.

11. The mopping unit of claim 1, wherein a peripheral portion of the base is flexible.

12. The mopping unit of claim 11, wherein the peripheral portion comprises fastening elements for said mopping substrate.

13. The mopping unit of claim 1, wherein the mop base is generally planar.

14. A method for manufacturing a mopping unit comprising:

molding a generally planar mop base having a bottom and top face and abutments on its top face such that the abutments are formed over two parallel reinforcing end segments of a coupling element, said reinforcing end segments are integral with and flanking a central, coupling segment, said coupling element is being coupled to a head unit that has a handle receptacle; and fixing attachment elements for attachment of a mopping substrate to said bottom face.

15. The method of claim 14, wherein fixing attachment elements comprises sewing the attaching elements to the bottom face.

16. The method of claim 14, further comprising, prior to molding, assembling the coupling element with the head unit such that a coupling portion of the head unit envelopes the central segment of the coupling element.

17. A mop base, being a single-piece molded article, comprising:

a coupling element;

a bottom face; and a top face, wherein the coupling element comprises two parallel elongated reinforcing end segments integral with and flanking a central, coupling segment; and two elongated bores formed in elongated abutments on the top face, each accommodating one of the two reinforcing end segments, wherein the mop base is configured for attaching a mopping substrate on its bottom face, wherein the mop base is made of rubber or silicone rubber, wherein a pivot element entirely envelops said coupling element for coupling a head unit to the mop base, and wherein the mop base comprises one or more ribs on the top face, extending from said abutments in a direction normal to the first axis.

18. A mopping unit comprising:

a mop base;

a head unit; and a coupling element, the coupling element including two parallel elongated reinforcing end segments integral with and flanking a central, coupling segment, wherein the mop base is a single-piece molded made of rubber or silicone rubber and article, and including a bottom face and a top face, and two elongated bores formed in elongated abutments on the top face, each accommodating one of the two reinforcing end segments, wherein in the mop base is configured for attaching a mopping substrate on the bottom face, wherein the head unit is pivotally coupled to said central segment to permit it to pivot about a first axis essentially parallel to said central segment and comprising a receptacle for an end of a mopping handle, wherein the head unit includes a coupling portion entirely enveloping the central segment, and wherein each of the reinforcing end segments is at least two times larger than the central segment.

* * * * *